US009316128B2

(12) United States Patent
Kandolf et al.

(10) Patent No.: US 9,316,128 B2
(45) Date of Patent: Apr. 19, 2016

(54) DUAL INDEPENDENT PHASING SYSTEM WITH SEPARATE OIL FEEDS

(71) Applicant: Schaeffler Technologies GmbH & Co. KG, Herzogenaurach (DE)

(72) Inventors: Michael Kandolf, St. Clair, MI (US); Matthias Kapp, Oak Park, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 114 days.

(21) Appl. No.: 14/307,044

(22) Filed: Jun. 17, 2014

(65) Prior Publication Data

US 2015/0000623 A1 Jan. 1, 2015

Related U.S. Application Data

(60) Provisional application No. 61/840,027, filed on Jun. 27, 2013.

(51) Int. Cl.

| | |
|---|---|
| ***F01L 1/34*** | (2006.01) |
| ***F01L 1/344*** | (2006.01) |
| *F01L 1/053* | (2006.01) |

(52) U.S. Cl.

CPC ..... *F01L 1/344* (2013.01); *F01L 1/3442* (2013.01); *F01L 2001/0537* (2013.01); *F01L 2001/34483* (2013.01); *F01L 2001/34493* (2013.01); *Y10T 29/49231* (2015.01)

(58) Field of Classification Search

CPC ... F01L 1/34; F01L 2001/34493; B21D 53/84
USPC ..... 123/90.15, 90.17, 90.31
See application file for complete search history.

(56) References Cited

U.S. PATENT DOCUMENTS

| | | | | |
|---|---|---|---|---|
| 7,789,054 | B2 | 9/2010 | Rozario et al. | |
| 8,051,818 | B2 | 11/2011 | Myers et al. | |
| 8,191,521 | B2 | 6/2012 | Kandolf et al. | |
| 2009/0173297 | A1 * | 7/2009 | Hutcheson | F01L 1/047 123/90.16 |

* cited by examiner

*Primary Examiner* — Zelalem Eshete
(74) *Attorney, Agent, or Firm* — Simpson & Simpson, PLLC

(57) ABSTRACT

A phasing system, including: a first phaser section including a first stator non-rotatably connected to a drive sprocket and first chambers formed by a first rotor and the first stator; a second phaser section located in a first axial direction from the first phaser section and including a second stator non-rotatably connected to the drive sprocket and second chambers formed by a second rotor and the second stator; a first portion of a camshaft non-rotatably connected to the first rotor, extending past the first stator in a second axial direction, and including first channels arranged to supply fluid to the first chambers; and a second portion of the camshaft non-rotatably connected to the first portion of the camshaft and extending past the second stator in the first axial direction and including second channels arranged to provide fluid to the second chambers.

20 Claims, 10 Drawing Sheets

DUAL INDEPENDENT PHASING SYSTEM WITH SEPARATE OIL FEEDS

CROSS-REFERENCE TO RELATED APPLICATIONS

This application claims the benefit under 35 U.S.C. §119 (e) of U.S. Provisional Patent Application No. 61/840,027, filed Jun. 27, 2013, which application is incorporated herein by reference in its entirety.

TECHNICAL FIELD

The present disclosure relates to a dual independent phasing system for independently phasing intake and exhaust camshafts of an engine. In particular, the dual independent phasing system includes two axially stacked phaser sections, one of which is supplied oil from the front of the system and the other of which is supplied oil from the back of the system.

BACKGROUND

Commonly owned U.S. Pat. No. 8,051,818 discloses a dual independent phasing system (DIPS) with axially stacked phaser sections and a camshaft assembly with two concentric camshafts extending in the same axial direction from the rear of the phaser sections. Oil for operating the respective chambers for phasing the camshafts is fed to the chambers via openings and channels in the two camshafts. However, in some instances, only one camshaft can be directly driven by the DIPS and oil for operating one of the channels cannot be supplied from the rear of the phaser sections.

SUMMARY

According to aspects illustrated herein, there is provided a dual independent phasing system, including: a drive sprocket arranged to receive torque; a first phaser section including a first stator non-rotatably connected to the drive sprocket and a first plurality of chambers formed by a first rotor and the first stator; a second phaser section, located in a first axial direction from the first phaser section, and including a second stator non-rotatably connected to the drive sprocket and a second plurality of chambers formed by a second rotor and the second stator; a first portion of a first camshaft non-rotatably connected to the first rotor and extending past the first stator in a second axial direction, opposite the first axial direction and including a first plurality of channels arranged to supply fluid to the first plurality of chambers; and a second portion of the first camshaft non-rotatably connected to the first portion of the first camshaft and extending past the second stator in the first axial direction and including a second plurality of channels arranged to provide fluid to the second plurality of chambers. The first plurality of chambers is arranged to circumferentially position, in response to fluid pressure in the first plurality of chambers, the first and second portions of the camshaft with respect to the drive sprocket. The second plurality of chambers is arranged to circumferentially position, in response to fluid pressure in the second plurality of chambers, the second rotor with respect to the drive sprocket.

According to aspects illustrated herein, there is provided a dual independent phasing system, including: a drive sprocket arranged to receive torque; a first phaser section including a first stator non-rotatably connected to the drive sprocket and a first plurality of chambers formed by a first rotor and the first stator; a second phaser section, located in a first axial direction from the first phaser section, and including a second stator non-rotatably connected to the drive sprocket and a second plurality of chambers formed by a second rotor and the second stator; a first portion of a first camshaft non-rotatably connected to the first rotor, extending past the first stator in the second axial direction and including a first plurality of channels arranged to supply fluid to the first plurality of chambers; and a second portion of the first camshaft non-rotatably connected to the first portion of the first camshaft, extending past the second stator in the first axial direction and including a second plurality of channels arranged to provide fluid to the second plurality of chambers. The first plurality of chambers is arranged to circumferentially position, in response to fluid pressure in the first plurality of chambers, the first and second portions of the camshaft with respect to the drive sprocket. The second plurality of chambers is arranged to circumferentially position, in response to fluid pressure in the second plurality of chambers, the second rotor with respect to the drive sprocket.

According to aspects illustrated herein, there is provided a method of fabricating a dual independent phasing system, including: non-rotatably connecting a first stator for a first phaser section to a first side of a drive sprocket, the first side facing in a first axial direction; non-rotatably connecting a second stator for a second phaser section to a second side of the drive sprocket, the second side facing in a second axial direction opposite the first axial direction; forming a first plurality of chambers with a first rotor and the first stator; non-rotatably connected a first portion of a camshaft to the first rotor; and non-rotatably connecting a second portion of the camshaft to the first portion of the first camshaft. The first plurality of chambers is arranged to circumferentially position, in response to fluid pressure in the first plurality of chambers, the first and second portions of the camshaft with respect to the drive sprocket. The second plurality of chambers is arranged to circumferentially position, in response to fluid pressure in the second plurality of chambers, the second rotor with respect to the drive sprocket. The first portion of the camshaft extends past the first stator in the first axial direction and includes a first plurality of channels arranged to supply fluid to the first plurality of chambers. The second portion of the camshaft extends past the second stator in the second axial direction, opposite the first axial direction and includes a second plurality of channels arranged to provide fluid to the second plurality of chambers.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1A:
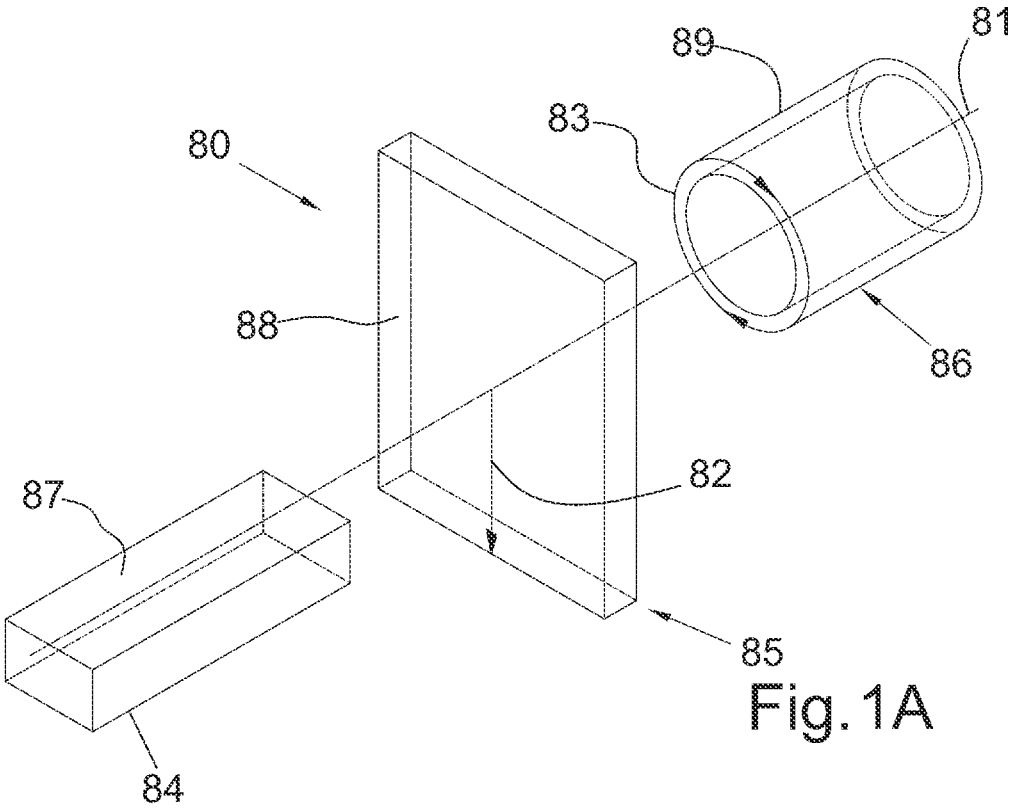
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present disclosure is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
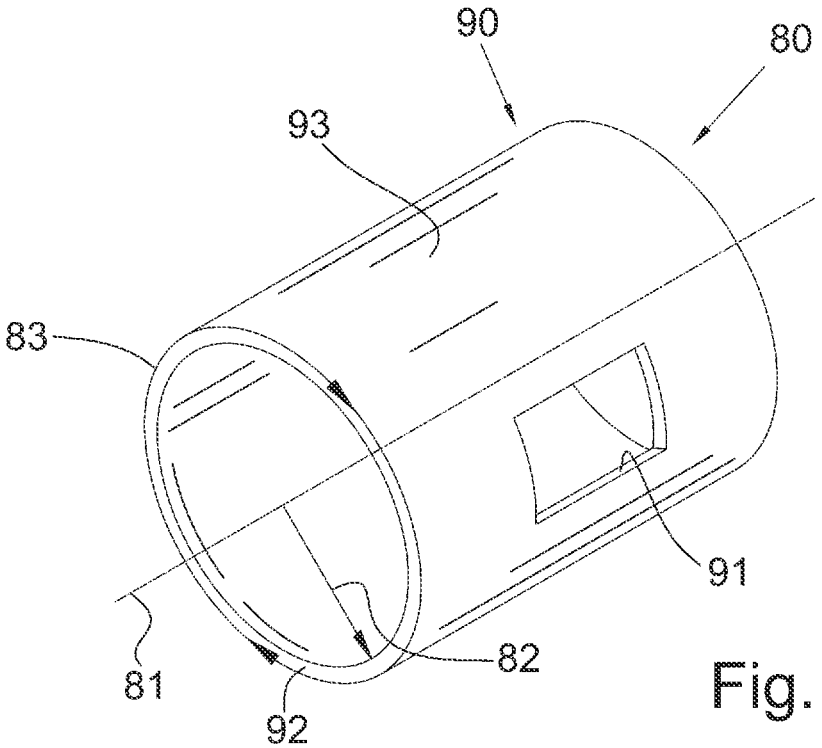
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
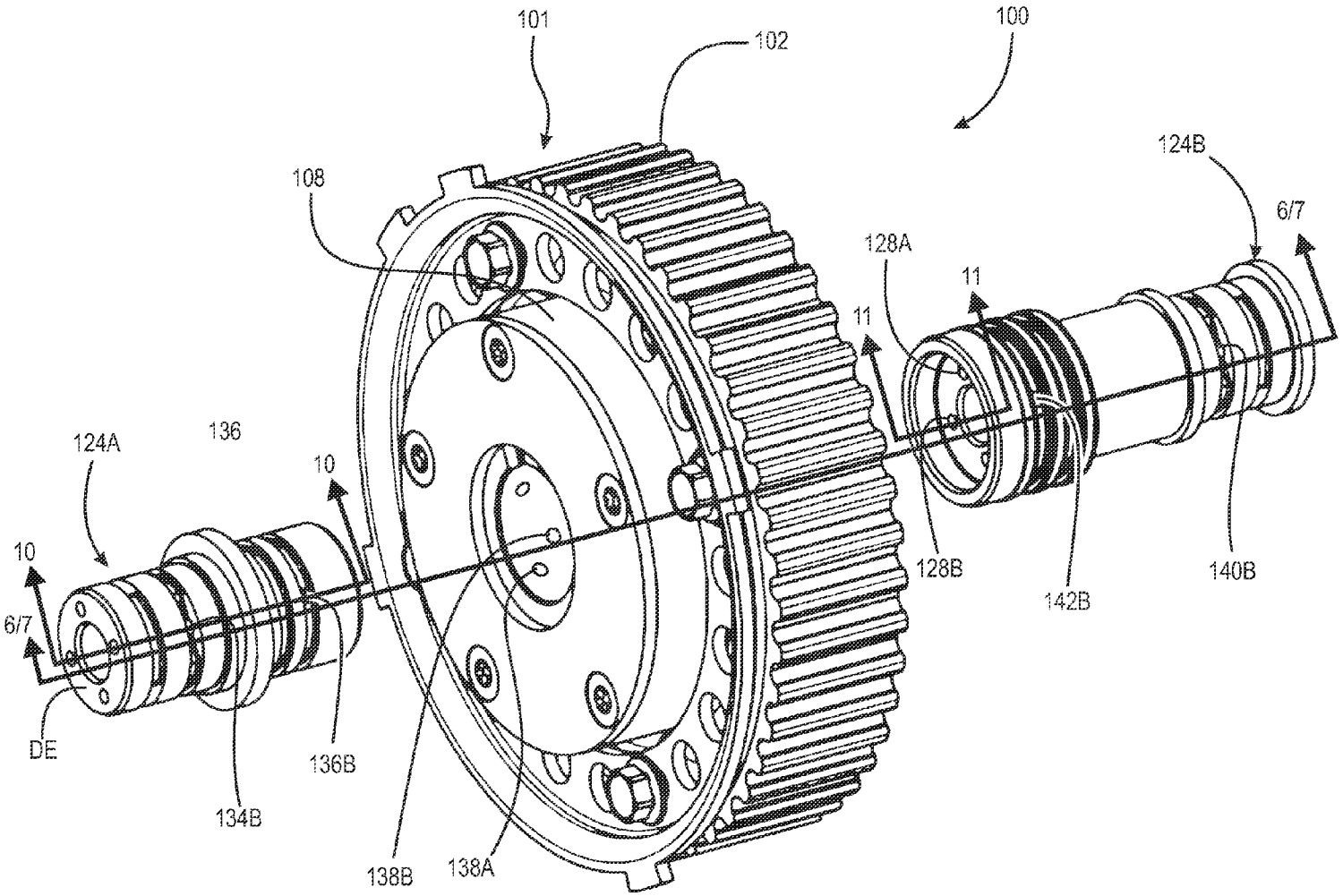
FIG. 2 is a perspective view of a dual independent phasing system with separate oil feeds showing camshaft portions.
Figure 3:
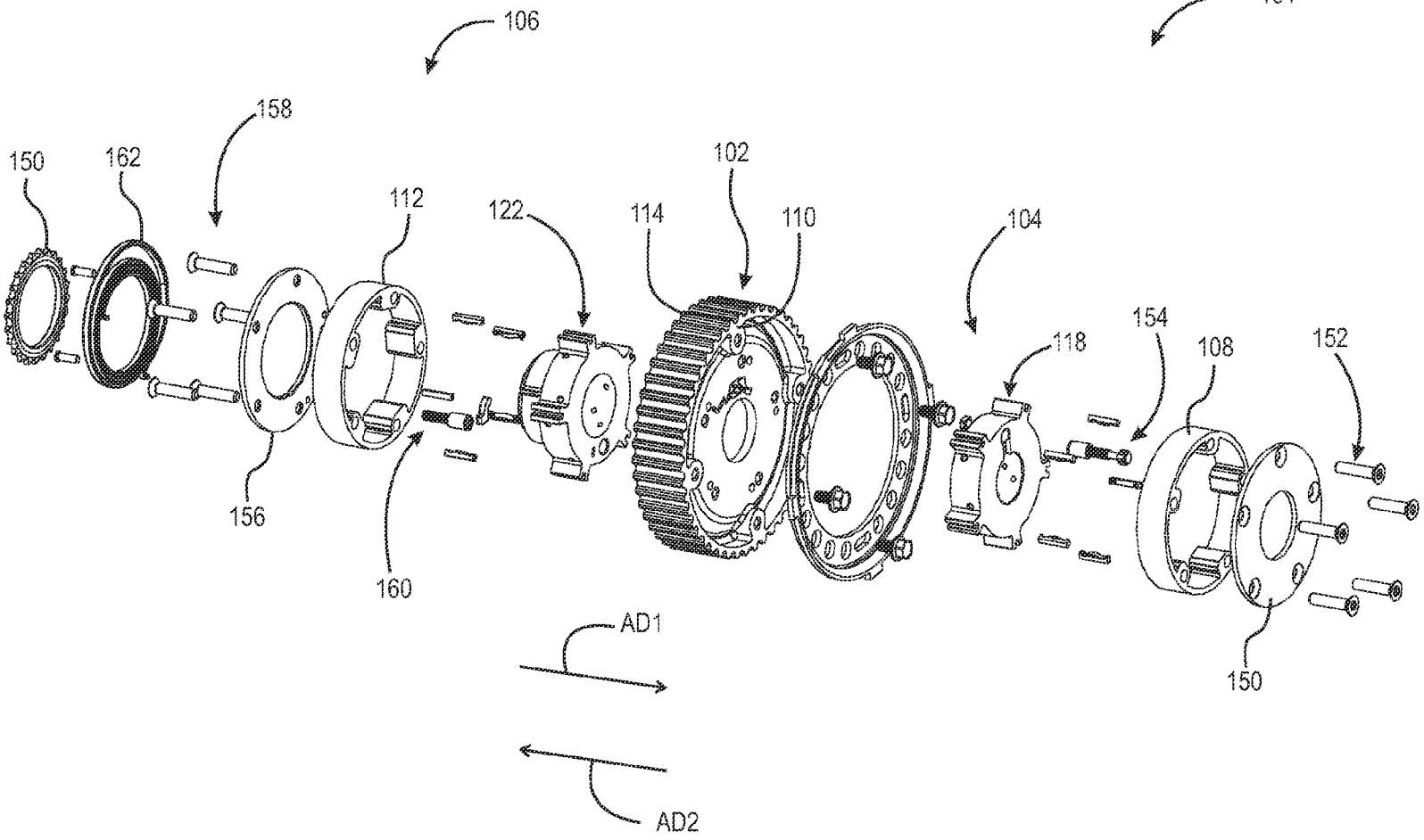
FIG. 3 is an exploded view of the dual independent phasing section in FIG. 2.

FIG. 2 is a perspective view of dual independent phasing system 100 with separate oil feeds showing camshaft portions;

FIG. 3 is an exploded view of the dual independent phasing section in FIG. 2.

Figure 4:
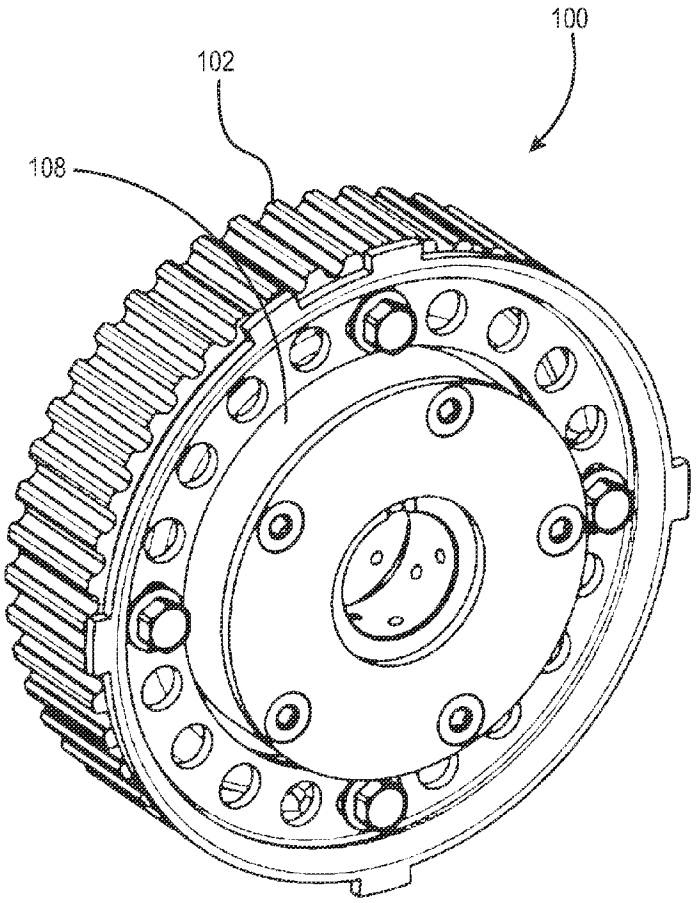
FIG. 4 is a front perspective view of the dual independent phasing section in FIG. 2.

FIG. 4 is a front perspective view of the dual independent phasing section in FIG. 2.

Figure 5:
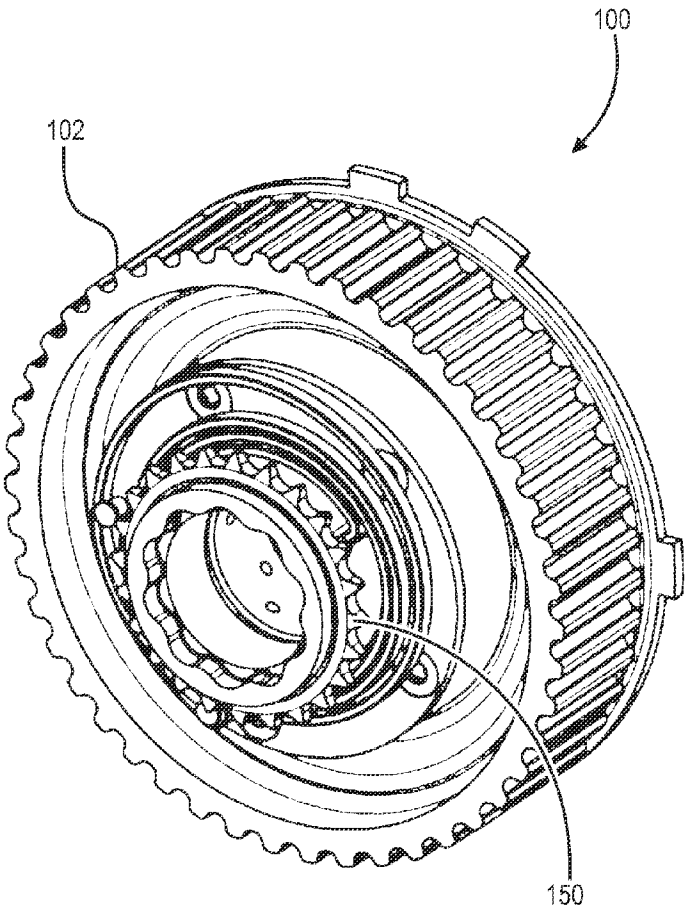
FIG. 5 is a back perspective view of the dual independent phasing section in FIG. 2.

FIG. 5 is a back perspective view of the dual independent phasing section in FIG. 2.

Figure 6:
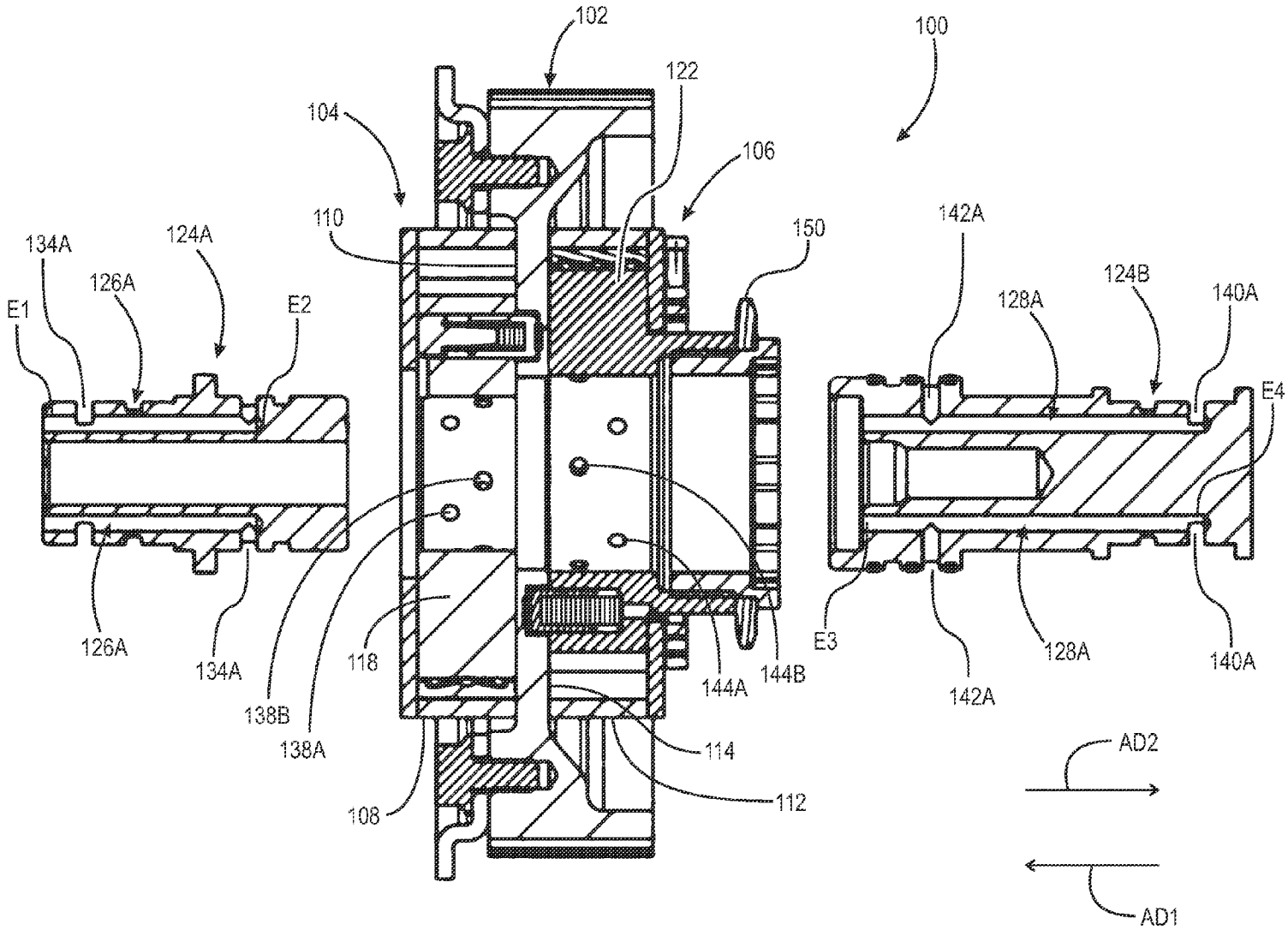
FIG. 6 is a cross-sectional view generally along line 6/7-6/7 in FIG. 2.

FIG. 6 is a cross-sectional view generally along line 6/7-6/7 in FIG. 2.

Figure 7:
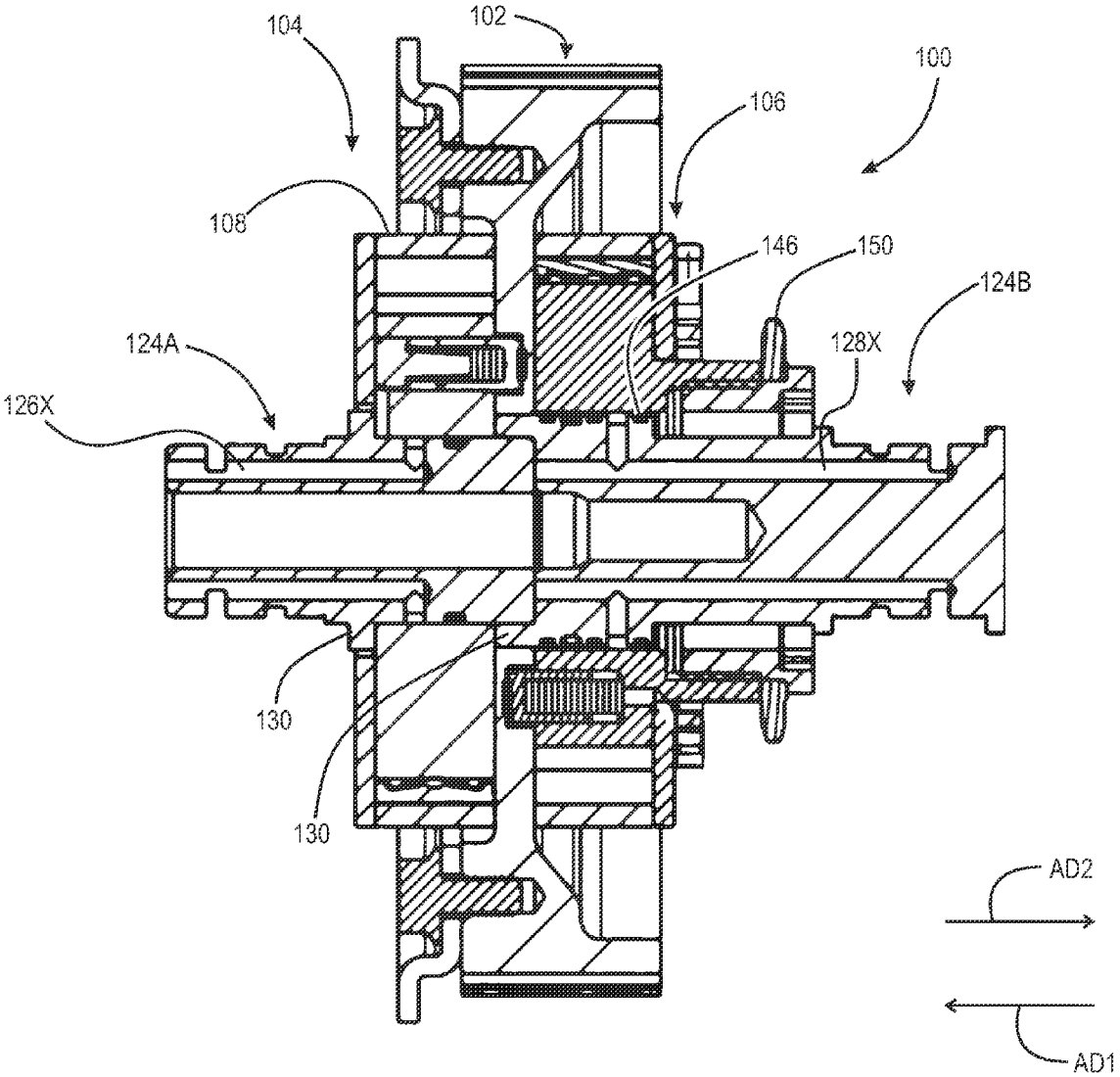
FIG. 7 is a cross-sectional view generally along line 6/7-6/7 in FIG. 2 with the camshaft portions attached.

FIG. 7 is a cross-sectional view generally along line 6/7-6/7 in FIG. 2 with the camshaft portions attached.

Figure 8:
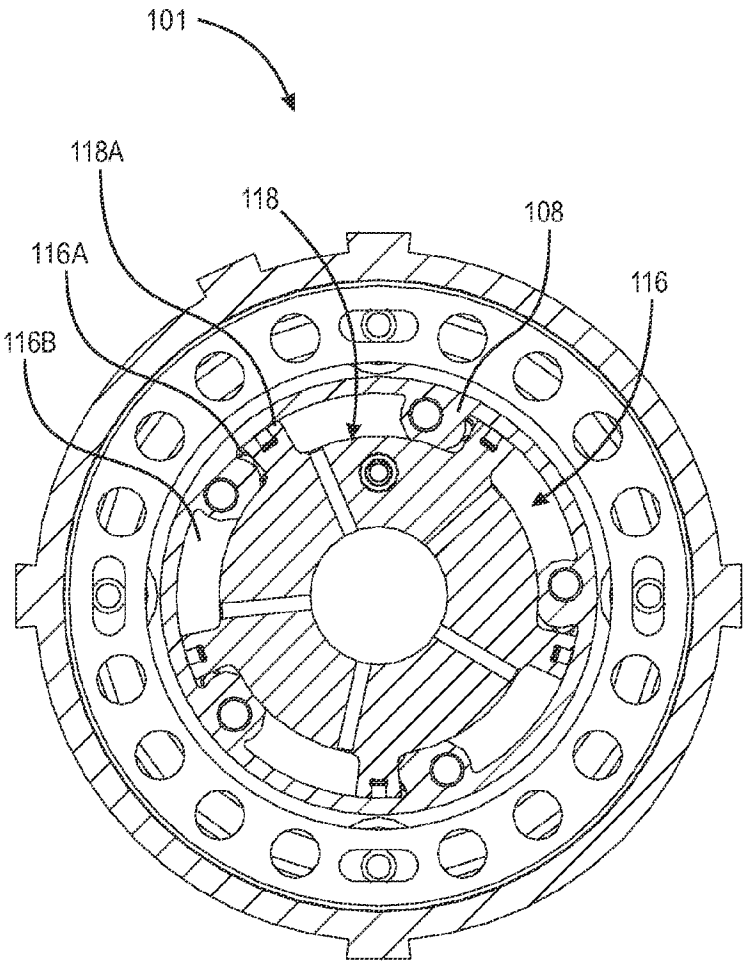
FIG. 8 is a front view showing chambers in one phaser section of the dual independent phasing section in FIG. 2.

FIG. 8 is a front view showing chambers in one phaser section of the dual independent phasing section in FIG. 2.

Figure 9:
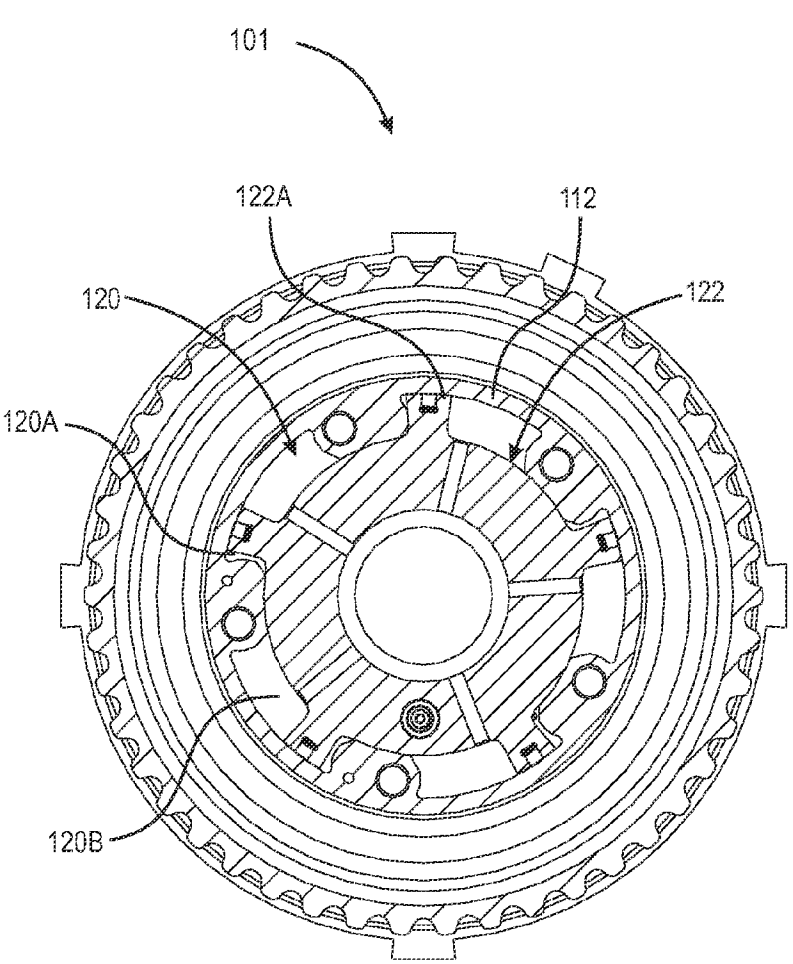
FIG. 9 is a rear view showing chambers in the other phaser section of the dual independent phasing section in FIG. 2.

FIG. 9 is a rear view showing chambers in the other phaser section of the dual independent phasing section in FIG. 2. The following should be viewed in light of FIGS. 2 through 9. Dual independent phasing system 100 includes phaser section 101 with drive sprocket 102 arranged to receive torque and phaser sections 104 and 106. Section 104 includes stator 108 non-rotatably connected side 110 of the drive sprocket and section 106 includes stator 112 non-rotatably connected to side 114 of the drive sprocket. Sides 110 and 114 facing in opposite axial directions AD1 and AD2, respectively. Phaser section 104 includes chambers 116 formed by rotor 118 and stator 108. Phaser section 106 includes chambers 120 formed by rotor 122 and stator 112. Rotors 118 and 122 include vanes 118A and 122A, respectively. Vanes 118 partially form respective portions 116A and 116B of chambers 116 and vanes 122A partially form respective portions 120A and 120B of chambers 120. System 100 includes camshaft 124 with portions 124A and 124B. Portions 124A and 124B are separate pieces and are non-rotatably connected to the phaser section. Portion 124A is non-rotatably connected to rotor 118. Portion 124B and rotor 122 are independently rotatable. Portion 124A extends past stator 108 in axial direction AD1 and portion 124B extends past stator 112 in axial direction AD2.

Figure 10:
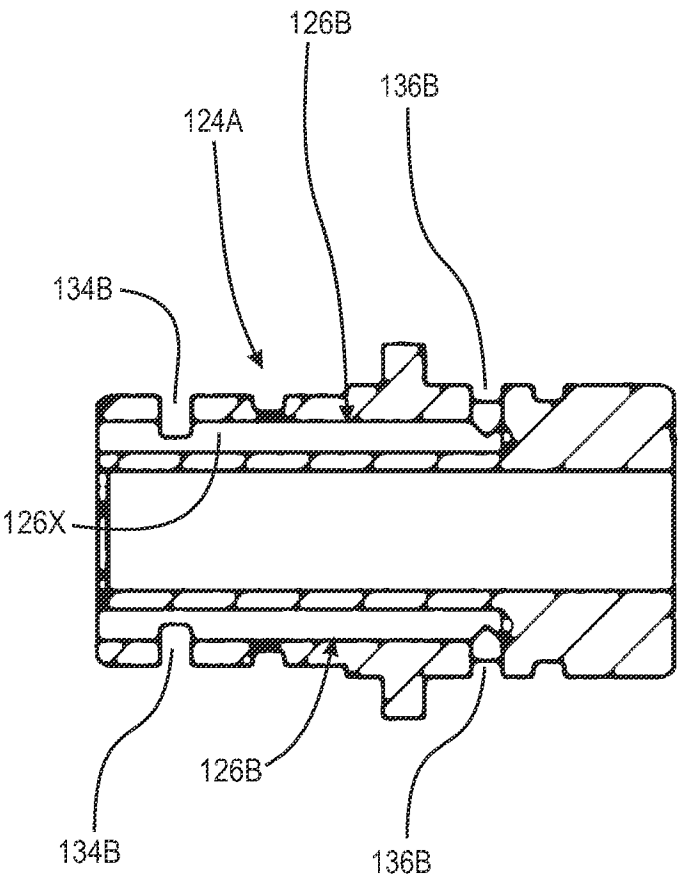
FIG. 10 is a cross-sectional view generally along line 10-10 in FIG. 2.

FIG. 10 is a cross-sectional view generally along line 10-10 in FIG. 2.

Figure 11:
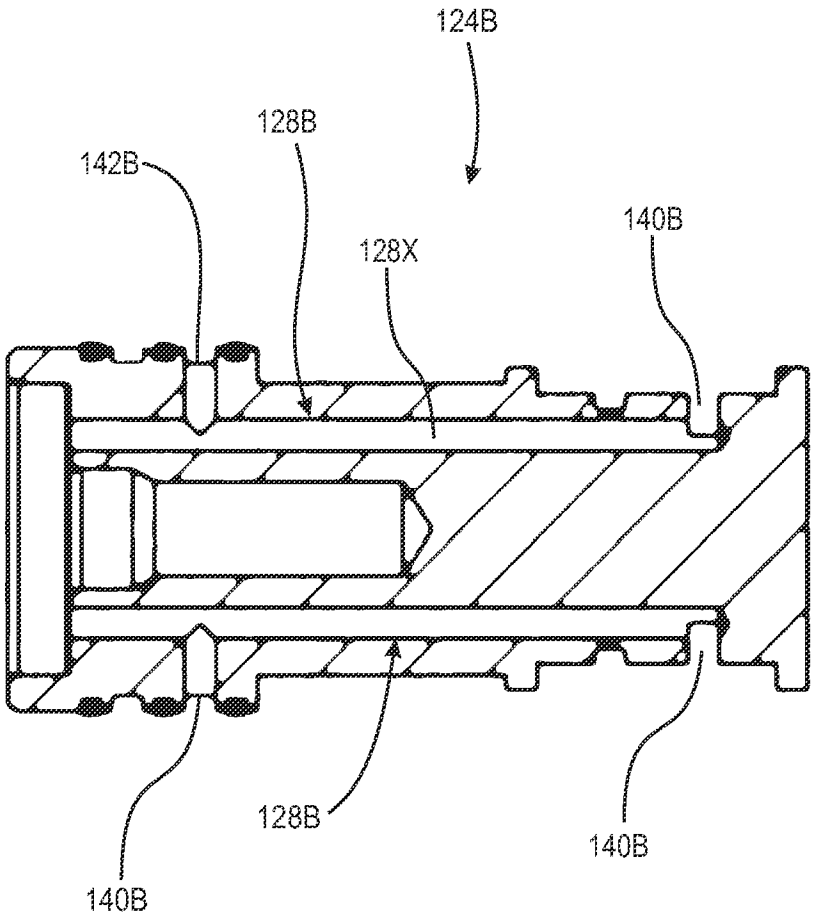
FIG. 11 is a cross-sectional view generally along line 11-11 in FIG. 2.

FIG. 11 is a cross-sectional view generally along line 11-11 in FIG. 2. The following should be viewed in light of FIGS. 2 through 11. Portion 124A includes channels 126A and 126B arranged to supply fluid to chamber portions 116A and 116B, respectively, and portion 124B includes channels 128A and 128B arranged to provide fluid to chambers portions 120A and 120B, respectively. Chambers 116 are arranged to circumferentially position, in response to fluid pressure in chambers 116, camshaft 124 with respect to the drive sprocket. Chambers 120 are arranged to circumferentially position, in response to fluid pressure in chambers 120, rotor 122 with respect to the drive sprocket.

In an example embodiment, rotor 118 is clamped between portions 124A and 124B. For example, rotor 118 is axially located between respective segments 130 of portions 124A and 124B, and section 102 is fixed by axial pressure exerted by segments 130. In an example embodiment, fastener 132 is used to non-rotatably connect portions 124A and 124B and to clamp rotor 118.

In an example embodiment, portion 124A includes openings 134A and 134B, facing radially outward proximate distal end DE of portion 124A, and openings 136A and 136B facing radially outward. Each channel 126A and 126B includes: a respective axially disposed segment 126X (at least partially defined by ends E1 and E2) connected to a respective opening 134A/B and a respective opening 136A/B. Rotor 118 includes openings 138A/B in hydraulic communication with chambers 116A/B and openings 136A/B. Thus, fluid introduced via openings 134A/B flows through channels 126A/B to chambers 116.

In an example embodiment, portion 124B, includes radially outwardly facing openings 140A and 140B and openings 142A and 142B. Each channel 128A and 128B includes: a respective axially disposed segment 128X (at least partially defined by ends E3 and E4) connected to a respective opening 140A/B and a respective opening 142A/B. Rotor 122 includes openings 144A/B in hydraulic communication with chambers 120A/B and openings 142A/B. Thus, fluid introduced via openings 140A/B flows through channels 128A/B to chambers 120. Seals 146 are used to seal rotor 122 with respect to portion 124B and openings 144 to enable independent rotation of rotor 122 with respect to portion 124B.

In an example embodiment, the entirety of channels 126A/B is radially misaligned with channels 128A/B, that is, there is no radial overlap of channels 126 and 128. In an example embodiment, at least a portion of segments 126A is axially aligned with portions 128B.

Figure 12:
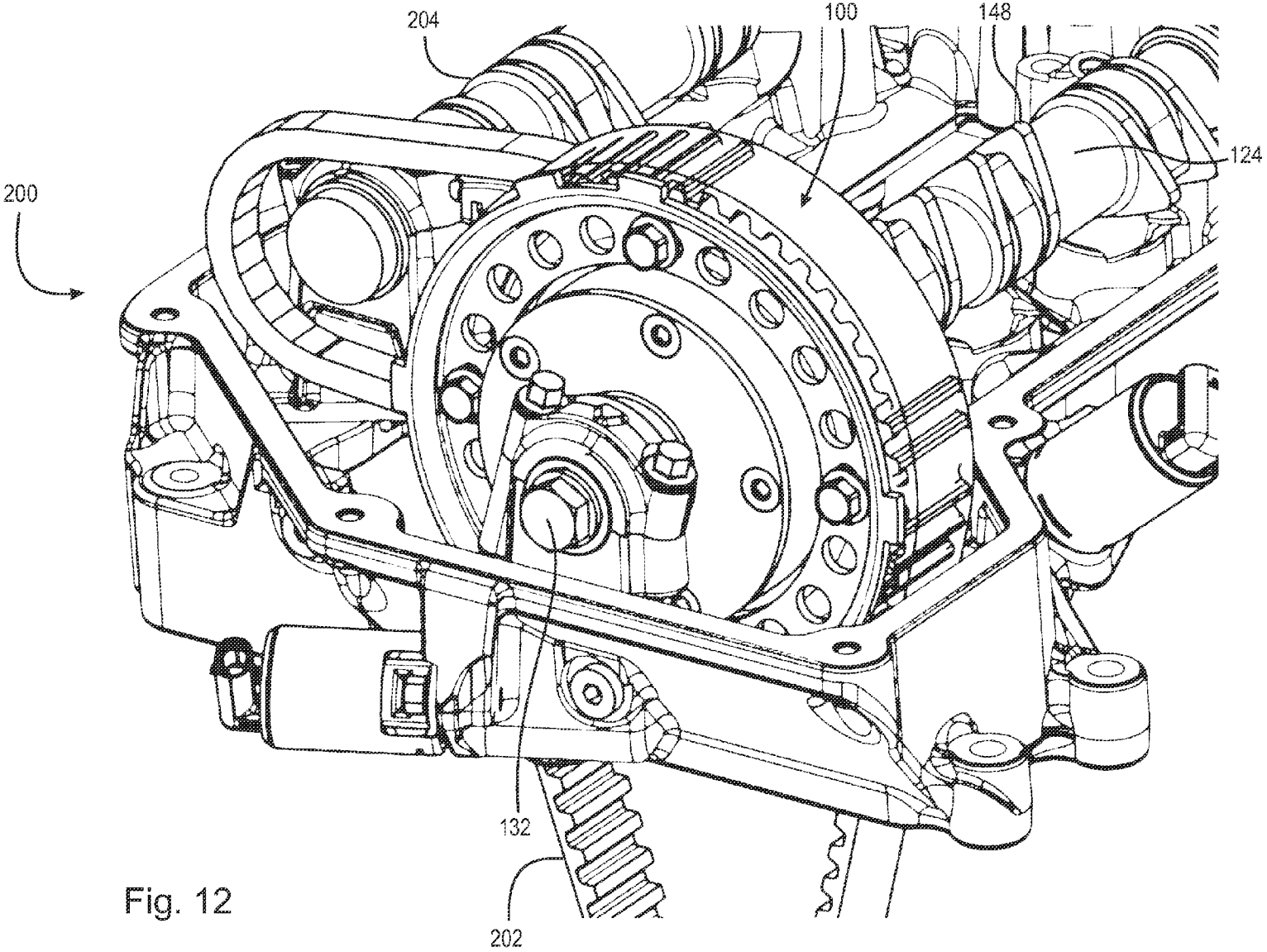
FIG. 12 is a perspective front view of the dual independent phasing system in FIG. 2 installed on an engine; and, FIG. 13 is a perspective back view of the dual independent phasing system in FIG. 2 installed on the engine.

FIG. 12 is a perspective front view of dual independent phasing system 100 in FIG. 2 installed on engine 200.

Figure 13:
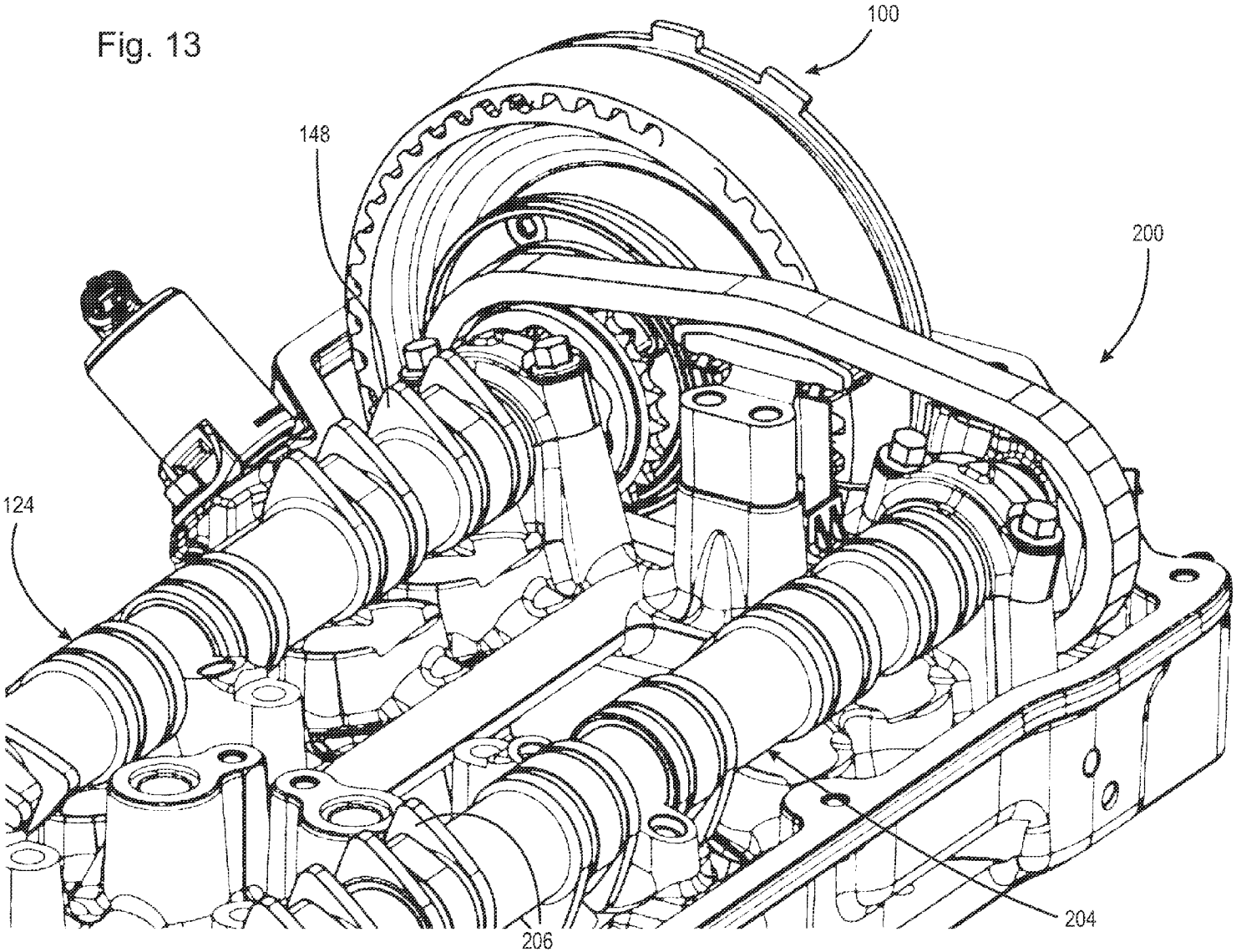

FIG. 13 is a perspective back view of dual independent phasing system 100 in FIG. 2 installed on engine 200. The following provides further detail regarding system 100 and should be viewed in light of FIGS. 2 through 13. Drive sprocket 102 is driven by a crankshaft (not visible in FIG. 12 or 13) for engine 200 via belt or chain 202. The structure and function of engine 200 require: camshaft 124 to be one of an intake or exhaust camshaft, operating cam lobes 148; and a separate camshaft 204 to be the other of the intake or exhaust camshaft, operating cam lobes 206. There is insufficient packaging space to enable a phasing section to be located at and directed connected to camshaft 204; therefore, section 106 provides torque to camshaft 204 and phases camshaft 204 with respect to sprocket 102. For example, sprocket 150 is non-rotatably connected to rotor 122 and provides torque to camshaft 204 via a belt or chain. As noted above, chambers 116 are used to phase rotor 122 with respect to stator 110 and drive sprocket 102.

Channels 128 are used to feed fluid to chambers 116 to phase section 106; however, due to limited packaging space, fluid for phasing section 104 must be fed from the front of system 100. Advantageously, channels 126 in camshaft portion 124A provide a path for supplying fluid to section 104 from the front of system 100.

The following provides further exemplary information regarding assembly 100. In an example embodiment, section 104 includes seal plate 152, fasteners 154, and locking pin assembly 156. Fasteners 154 are used to non-rotatably connect plate 150, stator 108, and sprocket 102. Locking pin assembly 154 is used to lock rotor 118 in a default position. In an example embodiment, section 106 includes seal plate 156, fasteners 158, locking pin assembly 160, and spring 162. Fasteners 158 are used to non-rotatably connect plate 156, stator 108, and sprocket 102. Locking pin assembly 160 is used to lock rotor 122 in a default position. Spring 162 is used to rotationally urge rotor 122 into a default position.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A dual independent phasing system, comprising:

a drive sprocket arranged to receive torque;

a first phaser section including:

a first stator non-rotatably connected to the drive sprocket; and, a first plurality of chambers formed by a first rotor and the first stator;

a second phaser section, located in a first axial direction from the first phaser section, and including:

a second stator non-rotatably connected to the drive sprocket; and, a second plurality of chambers formed by a second rotor and the second stator;

a first portion of a first camshaft:

non-rotatably connected to the first rotor and extending past the first stator in a second axial direction, opposite the first axial direction; and, including a first plurality of channels arranged to supply fluid to the first plurality of chambers; and, a second portion of the first camshaft:

non-rotatably connected to the first portion of the first camshaft and extending past the second stator in the first axial direction; and, including a second plurality of channels arranged to provide fluid to the second plurality of chambers, wherein:

the first plurality of chambers is arranged to circumferentially position, in response to fluid pressure in the first plurality of chambers, the first and second portions of the camshaft with respect to the drive sprocket; and, the second plurality of chambers is arranged to circumferentially position, in response to fluid pressure in the second plurality of chambers, the second rotor with respect to the drive sprocket.

2. The dual independent phasing system of claim 1, wherein:

the first portion of the first camshaft extends beyond the first phaser section in the second axial direction; and, the second portion of the first camshaft extends beyond the second phaser section in the first axial direction.

3. The dual independent phasing system of claim 1, wherein:

at least a portion of the first phaser section is axially located between respective segments of the first and second portions of the first camshaft; and, the first phase section is fixed by axial pressure exerted by the respective segments of the first and second portions of the first camshaft.

4. The dual independent phasing system of claim 1, wherein:

the first rotor is non-rotatably connected to the first portion of the first camshaft.

5. The dual independent phasing system of claim 1, wherein:

the first stator is fixedly secured to a first side of the drive sprocket facing in the second axial direction; and, the second stator is fixedly secured to a second side of the drive sprocket facing in the first axial direction.

6. The dual independent phasing system of claim 1, wherein:

each channel in the first plurality of channels includes: a respective axially aligned segment connected to respective opening from first and second pluralities of openings; and, the first rotor includes a plurality of openings in hydraulic communication with the first plurality of chambers and the second plurality of openings.

7. The dual independent phasing system of claim 1, wherein:

the second portion of the first camshaft includes first and second pluralities of radially outwardly facing openings;

each channel in the second plurality of channels includes a respective axially aligned segment connected to respective openings from the first and second pluralities of radially outwardly facing openings; and, the second rotor includes a plurality of openings in hydraulic communication with the second plurality of chambers and the second plurality of radially outwardly facing openings.

8. The dual independent phasing system of claim 1, wherein:

the entirety of the first plurality of channels is radially misaligned with the second plurality of channels.

9. The dual independent phasing system of claim 1, wherein:

each channel in the first plurality of channels includes a respective first axial portion extending in an axial direction and connecting respective first and second ends of the respective first axial portion aligned in the axial direction;

each channel in the second plurality of channels includes a respective second axial portion extending in the axial direction and connecting respective third and fourth ends of the respective second axial portion aligned in the axial direction; and, at least respective segments of the respective first and second axial portions are at a same radial distance from an axis of rotation for the camshaft phaser.

10. The dual independent phasing system of claim 1, wherein:

the first portion of the first camshaft is formed of a first single piece of material; and, the second portion of the first camshaft is formed of a second single piece of material different from the first piece of material.

11. A dual independent phasing system, comprising:

a drive sprocket arranged to receive torque;

a first phaser section including:

a first stator non-rotatably connected to the drive sprocket; and, a first plurality of chambers formed by a first rotor and the first stator;

a second phaser section, located in a first axial direction from the first phaser section, and including:

a second stator non-rotatably connected to the drive sprocket; and, a second plurality of chambers formed by a second rotor and the second stator;

a first portion of a first camshaft:

non-rotatably connected to the first rotor;

extending past the first stator in the second axial direction; and, including a first plurality of channels arranged to supply fluid to the first plurality of chambers; and, a second portion of the first camshaft:

non-rotatably connected to the first portion of the first camshaft;

extending past the second stator in the first axial direction; and, including a second plurality of channels arranged to provide fluid to the second plurality of chambers, wherein:

the first plurality of chambers is arranged to circumferentially position, in response to fluid pressure in the first plurality of chambers, the first and second portions of the camshaft with respect to the drive sprocket;

the second plurality of chambers is arranged to circumferentially position, in response to fluid pressure in the second plurality of chambers, the second rotor with respect to the drive sprocket.

12. The dual independent phasing system of claim 11, wherein:

the first portion of the first camshaft includes:

a first plurality of openings, facing in the second axial direction, at a distal end of the first portion; and, a second plurality of openings facing radially outward;

each channel in the first plurality of channels includes a respective axially aligned segment connected to respective openings from the first and second pluralities of openings; and, the first rotor includes a plurality of openings in hydraulic communication with the first plurality of chambers and the second plurality of openings.

13. The dual independent phasing system of claim 11, wherein:

the second portion of the first camshaft includes first and second pluralities of radially outwardly facing openings;

each channel in the second plurality of channels includes a respective axially aligned segment connected to respective openings from the first and second pluralities of radially outwardly facing openings; and, the second rotor includes a plurality of openings in hydraulic communication with the second plurality of chambers and the second plurality of radially outwardly facing openings.

14. The dual independent phasing system of claim 11, wherein:

the entirety of the first plurality of channels is radially misaligned with the second plurality of channels.

15. The dual independent phasing system of claim 11, wherein:

each channel in the first plurality of channels includes a respective first axial portion extending in an axial direction and connecting respective first and second ends of the respective first axial portion aligned in the axial direction;

each channel in the second plurality of channels includes a respective second axial portion extending in the axial direction and connecting respective third and fourth ends of the respective second axial portion aligned in the axial direction; and, at least respective segments of the respective first and second axial portions are at a same radial distance from an axis of rotation for the camshaft phaser.

16. A method of fabricating a dual independent phasing system, comprising:

non-rotatably connecting a first stator for a first phaser section to a first side of a drive sprocket, the first side facing in a first axial direction;

non-rotatably connecting a second stator for a second phaser section to a second side of the drive sprocket, the second side facing in a second axial direction opposite the first axial direction;

forming a first plurality of chambers with a first rotor and the first stator;

non-rotatably connected a first portion of a camshaft to the first rotor;

non-rotatably connecting a second portion of the camshaft to the first portion of the first camshaft, wherein:

the first plurality of chambers is arranged to circumferentially position, in response to fluid pressure in the first plurality of chambers, the first and second portions of the camshaft with respect to the drive sprocket;

the second plurality of chambers is arranged to circumferentially position, in response to fluid pressure in the second plurality of chambers, the second rotor with respect to the drive sprocket;

the first portion of the camshaft extends past the first stator in the first axial direction and includes a first plurality of channels arranged to supply fluid to the first plurality of chambers; and, the second portion of the camshaft extends past the second stator in the second axial direction, opposite the first axial direction and includes a second plurality of channels arranged to provide fluid to the second plurality of chambers.

17. The method of claim 16, further comprising:

non-rotatably connecting the first rotor to the first portion of the camshaft.

18. The method of claim 16, wherein:

the first portion of the first camshaft includes:

a first plurality of openings, facing in the second axial direction, at a distal end of the first portion; and, a second plurality of openings facing radially outward;

each channel in the first plurality of channels includes a respective axially aligned segment connected to respective opening from the first and second pluralities of openings; and, the first rotor includes a plurality of openings in hydraulic communication with the first plurality of chambers and the second plurality of openings.

19. The method of claim 16, wherein:

the second portion of the first camshaft includes first and second pluralities of radially outwardly facing openings;

each channel in the second plurality of channels includes a respective axially aligned segment connected to respective openings from the first and second pluralities of radially outwardly facing openings; and, the second rotor includes a plurality of openings in hydraulic communication with the second plurality of chambers and the second plurality of radially outwardly facing openings.

20. The method of claim 16, wherein:

the entirety of the first plurality of channels is radially misaligned with the second plurality of channels.

* * * * *